US008113075B2

(12) United States Patent
Schmid

(10) Patent No.: US 8,113,075 B2
(45) Date of Patent: Feb. 14, 2012

(54) DRIVE FOR RECLINING FURNITURE

(75) Inventor: Kurt Schmid, Buende (DE)

(73) Assignee: Limoss GmbH & Co. KG, Wetter (DE)

( * ) Notice: Subject to any disclaimer, the term of this patent is extended or adjusted under 35 U.S.C. 154(b) by 607 days.

(21) Appl. No.: 12/334,556

(22) Filed: Dec. 15, 2008

(65) Prior Publication Data

US 2010/0170356 A1 Jul. 8, 2010

(30) Foreign Application Priority Data

Dec. 13, 2007 (DE) ..... 10 2007 060 112
Dec. 22, 2007 (DE) ..... 10 2007 062 300

(51) Int. Cl.
*F16H 3/06* (2006.01)
*F16H 29/20* (2006.01)

(52) U.S. Cl. ..... 74/89.23; 74/425

(58) Field of Classification Search ..... 74/89.23, 74/89.32, 89.33, 425, 89.15, 459, 458, 509; 297/362, 362.11, 362.12, 330, 362.14, 344.1, 297/344.11

See application file for complete search history.

(56) References Cited

U.S. PATENT DOCUMENTS 5,311,788 A * 5/1994 Kasuga ..... 74/89.33
5,467,957 A * 11/1995 Gauger ..... 248/429
5,927,144 A * 7/1999 Koch ..... 74/89.36
6,952,976 B2 * 10/2005 Roither et al. ..... 74/425
7,963,181 B2 * 6/2011 Zeng ..... 74/89.23

FOREIGN PATENT DOCUMENTS

DE 3842078 7/1989
DE 4136373 5/1993

* cited by examiner

*Primary Examiner* — Robert Pezzuto

(57) ABSTRACT

A drive mechanism for a piece of reclining furniture. The mechanism has a housing whose side walls are formed adjacent an upper wall with a pair of longitudinally spaced seats defining a pair of generally parallel and transversely extending axes lying in a common first plane. Respective furniture shafts rotatable in the seats are connectable to parts of the piece of reclining furniture, and respective arms project from the furniture shafts. Respective servomotors in the housing each have an output shaft defining an output rotation axis. The output rotation axes define a second plane forming an angle greater than 0° with the first plane, respective transmissions and links between the output shafts and the control arms so that rotation of the output shafts is transmitted through the respective transmissions and links to the control arms to rotate the furniture shafts.

20 Claims, 5 Drawing Sheets

6
8
9
25
2
10
18
16
19
16
18
10
25
8
9
P1
6
1
15
3
17
11
24
24
11
17

1
VII
6
20
21
22
21
10
5
4
VII
6

DRIVE FOR RECLINING FURNITURE

FIELD OF THE INVENTION

The present invention relates to a drive for a piece of furniture. More particularly this invention concerns a drive mechanism for a piece of reclining furniture.

BACKGROUND OF THE INVENTION

A drive mechanism for moving parts of seating or reclining furniture, in particular, for slatted frames of couches or beds, comprises a housing that has a upper wall facing the adjustable part, a lower wall facing away from the adjustable part, two approximately parallel side walls, and two preferably approximately parallel end wall. The upper wall close to the end wall and the end wall have notches that each receive a shaft that is rotatably attached to the furniture and that has operating arms for moving parts of the furniture. The housing preferably has locking parts that capture the shaft in the desired installation position on the housing. Two servomotors each having an output shaft, one transmission, one thrust spindle, a spindle nut and a thrust piece connected thereto are mounted in the housing preferably between the notches. The thrust piece acts on a control arm projecting from the shaft toward the lower wall of the housing. The height of the housing between the upper wall and the lower wall is slightly larger than the diameter of the shaft plus the length of the control arm.

A drive mechanism of this type is disclosed, for example, in DE 3,842,078. Such a drive mechanism is quite bulky so that it requires a large shipping volume when transported from the manufacturer of the drive mechanisms to the user of the drive mechanisms, that is, the manufacturers of seating and reclining furniture.

In a first embodiment that is illustrated in FIGS. 3 and 4 of this German patent, the servomotors project outward from the side walls of the housing, with the result that the shipping volume for these parts is very large due to the motors projecting beyond the side walls of the housing. In a second embodiment illustrated in FIG. 5 of this patent, the motors are mounted inside wall the housing and extend parallel to the respective connected at their center longitudinal axis that is determined by the output shaft, as is also true in the embodiment of FIGS. 3 and 4. Even in the case of the embodiment of FIG. 5, what results here is a large volume since in overall terms the housing must be designed large enough to enable the laterally projecting motors to be enclosed by the housing. This design too thus always results in a very large shipping volume.

The functional configuration and arrangement of the individual elements are very evident and well known from this prior art. In regard to the prior art, additional reference is made to DE 41 36 373. In FIG. 1 of this patent document, the shaft is rotatably attached to the corresponding furniture and has a control arm on which the thrust piece of the thrust spindle acts when the servomotor is operated and the thrust spindle is rotated in the spindle nut that is fixed in the housing. In this arrangement as well, the servomotors are provided so as to project laterally away from the housing, as is evident from the arrangement of the drive shaft. Thus here the locking parts clearly close the notch in which the shaft is journaled. The element designated as a closer engages guide grooves of the housing and forms an effective locking means for the shaft on the housing. In particular, what is also evident from FIG. 1 of this document is how the corresponding control arm is affixed to the shaft and which positions the lever can occupy depending on the position of the thrust piece connected to the thrust spindle.

OBJECTS OF THE INVENTION

It is therefore an object of the present invention to provide an improved drive for reclining furniture.

Another object is the provision of such an improved drive for reclining furniture that overcomes the above-given disadvantages, in particular that is in which an overall volume of the complete drive mechanism is achieved that is smaller than that of the prior art while maintaining the functional mode of operation of the drive mechanism.

SUMMARY OF THE INVENTION

A drive mechanism for a piece of reclining furniture. The mechanism has according to the invention a housing having longitudinally extending upper and lower walls, a pair of side walls extending vertically between the upper and lower walls, and a pair of longitudinally spaced end walls. The side walls are formed adjacent the upper wall with a pair of longitudinally spaced seats defining a pair of generally parallel and transversely extending axes lying in a common first plane, respective furniture shafts rotatable in the seats and connectable to parts of the piece of reclining furniture, respective arms projecting radially into the housing from rotation axes of the furniture shafts, respective servomotors in the housing between the upper, lower, and side walls thereof and each having and output shaft defining an output rotation axis. The output rotation axes defining a second plane forming an angle greater than 0° with the first plane, respective transmissions and links between the output shafts and the control arms so that rotation of the output shafts is transmitted through the respective transmissions and links to the control arms to rotate the furniture shafts.

In other words the output-shaft axes are not aligned parallel to the shafts. This is in contrast to the design known from the prior art in which the servomotors are aligned with their output-shaft axes parallel to the furniture shaft. Instead the servomotors according to the invention are aligned with their output-shaft axes not parallel to the shafts but at an angle that diverges therefrom. With such an alignment for the output-shaft axes of the drive shafts that deviates only slightly from the parallel alignment, what is achieved is only a slight reduction in the overall volume of the complete drive mechanism. However, as this angle becomes greater the width of the housing, and thus the housing volume, can be dimensioned with a smaller size.

Based on the assumption that the housing is essentially parallepipedal, the alignment of the servomotors within the housing can be provided in any manner desired, for example, parallel or transverse to the longitudinal axis of the housing, positioned at an angle to this longitudinal axis or transverse axis of the housing, approximately in the direction of a longitudinal diagonal of the housing or a longitudinally aligned frame diagonal of the housing, or even in a transversely aligned diagonal aligned or body diagonal.

The more the output-shaft axes of the servomotors are aligned such that they are oriented parallel to a center plane of the housing that runs parallel to the preferably parallel side walls of the housing, the smaller will be the overall volume of the complete drive mechanism, in particular, in terms of its dimension in width.

For a drive mechanism in which the shafts or the seats formed by the notches in the side walls of the housing for the shafts lie in a common first plane, provision is preferably made whereby the servomotors are mounted within the housing such that their output-shaft axes formed by their drive shaft are oriented at an angle relative to this first plane.

In the case of a parallepipedal design for the housing, the first plane extends parallel to the upper wall and lower wall of the housing. The output-shaft axes of the servomotors can lie within this first plane, but not parallel to the shafts but at an angle thereto. For example, the servomotors can be mounted with their output-shaft axis in the longitudinal axis of the housing at any desired angular position, or in the vertical axis of the housing at any desired angular position, or in the width axis of the housing at any desired angular position, except for the parallel alignment relative to the shafts, where a relatively larger or smaller overall design for the drive mechanism is achieved depending on the arrangement and angular position.

The servomotors with their output-shaft axis are not oriented in the first plane but at an angle to this reference plane, wherein in turn various overall sizes are implement able depending on the angular position and orientation in the longitudinal axis, transverse axis, or height axis of the housing, each of these sizes in every case having smaller dimensions than the design previously known from the prior art.

Provision is preferably made whereby the two servomotors are mounted in the housing such that their output-shaft axes lie in a second plane that intersects the first plane at an angle so that the servomotors each lie in the second plane. This approach is advantageous in terms of installation when, for example, the housing is either parallel to the second plane or is divided within the second plane, with the result that when the housing is open the requisite parts are installable in the housing and are held in place in the desired installation position by attaching a second housing part.

Provision is also preferably made whereby the angle between the output-shaft axis of the servomotors and shafts, or the angle between first plane and output-shaft axis of each servomotor, or the angle between first plane and second plane, is greater than 0° and less than 180°. An orientation close to the extreme values of 0° or 180° achieves only a slight reduction in the overall size of the housing, and thus of the drive mechanism. However, the further the orientation departs from these extreme values, the smaller the overall dimensions can be for the housing. A preferred approach here is one where the angle is greater than 45° and less than 135°. An especially preferred approach is one where the angle is greater than 60° and less than 120°. An especially preferred approach is one where the angle is 90°±10°.

In order to minimize the overall size of the complete housing of the drive mechanism, and thus the overall size of the drive mechanism, provision is preferably made whereby the length of each servomotor including the output shaft and a worm affixed thereon as a transmission part approximately equals the dimension of the housing as measured in the longitudinal axis of the servomotor between wall parts of the housing and its drive shaft, or is slightly greater than this dimension of the housing, where in this last case the housing has a cup-like projection which the end of the servomotor facing away from the worm engages.

Provision is preferably made here whereby the height of the cup-like projections is less than 10% the height of the housing between upper wall and lower wall. In addition, provision is preferably made here whereby the width of the housing between the housing's side walls is a maximum of 20% greater than the overall diameter of a servomotor.

In terms of a specific solution of the problem, the invention proposes that the servomotors be mounted in the housing such that their output-shaft axes formed by their output shaft lies in a plane that runs parallel to the center longitudinal plane of the housing that is aligned parallel to the side walls of the housing.

Unlike the design known from the prior art in which the servomotors with their output-shaft axis are aligned parallel to the shaft attached on the furniture side wall, according to the invention the servomotors with their output-shaft axis formed by the output shaft are aligned parallel to a center longitudinal plane of the housing that is aligned parallel to the side walls of the housing.

As a result, the overall volume of the drive mechanism is significantly reduced since the servomotors no longer project laterally away from the housing or are oriented within a large-volume housing parallel to the rotatable shaft of the furniture section, but instead the servomotors are mounted so as to be oriented within the slim housing such that the extension of their output-shaft axes passes through the upper or lower wall of the housing, or, on the other hand, the end wall of the housing. The height of the housing is in any case matched to the requisite dimension of the rotatable shaft that is insertable into the housing and attached to the furniture, plus the control arm. The arrangement and orientation according to the invention of the servomotors enable this height of the housing, already available in any case, to be exploited to dispose the servomotors within the housing such that a slim design for the housing is achievable that results in the complete drive mechanism's occupying a small volume, in other words, in its being inexpensive to ship.

Provision is preferably made here whereby the output shafts are aligned parallel to the side walls of the housing and orthogonally relative to the upper wall and lower wall of the housing.

This type of arrangement allows for a functional space-saving arrangement of the additional transmission elements, as well as of the thrust spindle, spindle nut, and thrust piece.

Provision is in particular preferably made here whereby the length of each servomotor including the output shaft and a worm as a transmission part affixed to this shaft is slightly greater than the height of the housing between the upper wall and lower wall, where the upper wall of the housing has cup-like projections which the end of the servomotors facing away from the worm engages.

While the overall width and overall length of the housing are not affected by this design, the overall height of the housing is in fact increased slightly, although the shipping volume achieved is nevertheless significantly smaller when compared with the prior art. The advantage of this arrangement is that the servomotors are centered and fixed by cup-like projections, although wall parts on which the servomotor is supported laterally are preferably still provided within the housing.

In order to keep the size of the overall height small despite the arrangement of the cup-like projections, provision is made whereby the height of the cup-like projections is less than 10% the height of the housing between upper wall and lower wall.

An alternative and preferred design is seen in an approach whereby the length of each servomotor including the output shaft and a worm affixed on this shaft as a transmission part is at maximum equal to the height of the housing between upper wall and lower wall.

What is achieved by this type of design for the servomotor is that the servomotor can be mounted within the housing contours between its upper wall and lower wall without the overall height having to be enlarged due to the arrangement of the servomotor.

As is known in the prior art per se, the height of the housing between upper wall and lower wall can be slightly greater than an amount that would correspond to the diameter of the shaft attached on the furniture side wall plus the length of the control arm. It is thus possible to insert the appropriate shaft into the housing, where the control arm has the corresponding free access in the housing to provide its functionality. It is not necessary to further enlarge the dimensions of the housing.

In addition, provision is preferably made whereby the width of the housing between the side walls is slightly greater than the overall diameter of the servomotor. Minimization of the overall height of the drive mechanism is also further improved by this design.

If, however, the servomotor or servomotors is/are mounted more centrally within the housing relative to the housing width, the drive mechanism becomes somewhat more complicated since the worm affixed to the output shaft of the servomotor is mounted at the center of the housing, with the result that the worm gear has to be offset from the longitudinal center of the housing so as to achieve effective engagement with the worm.

Consequently, the thrust spindle, spindle nut, and thrust piece must be mounted eccentrically, with the result that the engagement with the control arm of the furniture-side wall-attached shaft is also effected eccentrically as viewed relative to the housing center in the longitudinal axis.

In order to achieve, as before, the center force application on the control arm of the shaft, provision is therefore preferably made whereby the housing width between its side walls is slightly greater than the overall diameter of the servomotor, where the servomotors with their center axis are offset relative to center longitudinal plane of the housing toward one side wall, and the side wall has first bulges that correspond to the degree of offset such that the first bulges partially comprise the peripheral surfaces of the servomotors, where the overhang of the first bulges beyond the side walls is less than half the diameter of each servomotor, preferably, less than a quarter the diameter.

Although the overall width of the housing is slightly increased thereby, a significant decrease in the overall size is nevertheless achieved as compared with the prior art. In addition, however, the offset enables the transmission elements and the force-transmission elements to be provided centrally as viewed for the longitudinal axis of the housing, thereby also providing a central application of force on the control arm of the shaft mounted on the furniture side wall.

Since a slight modification in overall size in the width axis is caused in any case by the small bulges, provision can additionally be made whereby a second bulge is formed in the side wall between the first bulges of the side wall, this bulge projecting at maximum relative to the side wall by the extent of the first bulges, where the second bulge receives parts of a transformer that is connected on the input side wall of the servomotors.

This type of transformer is typically connected on the input side wall of the servomotors so that these do not have to be operated using high voltage. The bulges, in particular, the bulge for the transformer, provides an assembly aid for installation of the corresponding elements in the housing.

Also in order to facilitate assembly, provision is made whereby the housing is composed of two housing shells, where the joint face runs longitudinally, preferably, at the longitudinal center of the housing orthogonally to the upper wall and the lower wall of the housing.

During assembly, the appropriate parts of the drive mechanism can first be installed in one open half of the housing. The second half of the housing can then be mounted and the housing parts can be attached to each other, thereby providing the complete drive mechanism as a finished element.

In an approach that is known per se, the transmission is composed of a worm that is attached in a rotationally fixed manner to the output shaft of the servomotor, and a worm gear attached in a rotationally fixed manner to the thrust spindle, the worm gear engaging the worm.

Provision is preferably made here whereby the servomotor with worm is mounted centrally between the side walls of the housing, while the worm gear is mounted eccentrically offset next to the worm.

Alternatively and preferably, provision is made whereby the worm gear is mounted centrally between the lateral surfaces of the housing, while the servomotor is eccentrically offset next to the worm gear.

Also in the manner known per se, provision is made whereby the thrust spindle with its end section projecting beyond the worm gear is rotatably mounted in a bearing that is mounted so as to be fixed to the housing.

Provision is also preferably made here whereby one face of the housing, preferably a side wall of the housing, has at least one plug-in connector to connect electrical cables, which connector is situated within the housing and is connected through electrical wires to one servomotor or both servomotors.

This provides a simple means of plugging in the connection wires leading to the transformer to the drive mechanism, thereby enabling the drive mechanism to function.

In order to optimally utilize the available dimensions of the housing, provision is made whereby the servomotors are attached with a clearance relative to each other close to the longitudinal center of the housing, a transformer being electrically connected to the housing within the clearance area.

In addition to the advantage of a smaller overall height for the drive mechanism, another advantage achieved by the design according to the invention is the fact that significant stability is achieved for the housing despite the small size of the complete drive mechanism, since no outwardly projecting elements exposed to breakage are provided and the housing does not need to have cutouts in the walls to allow the motors to be connected.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
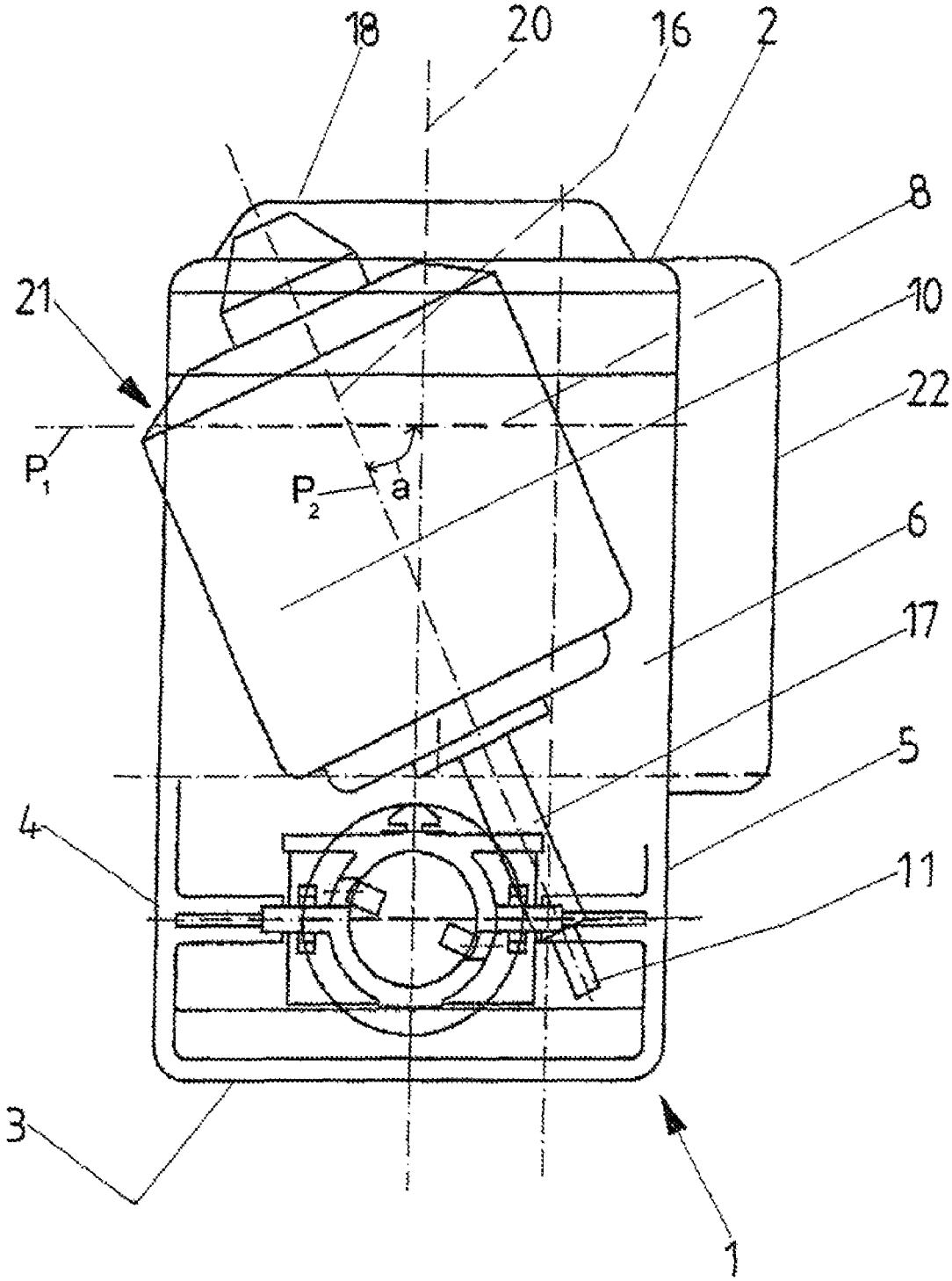
FIG. 1 is an end view of a drive mechanism according to the invention.
Figures 2, 3, 4, 5:
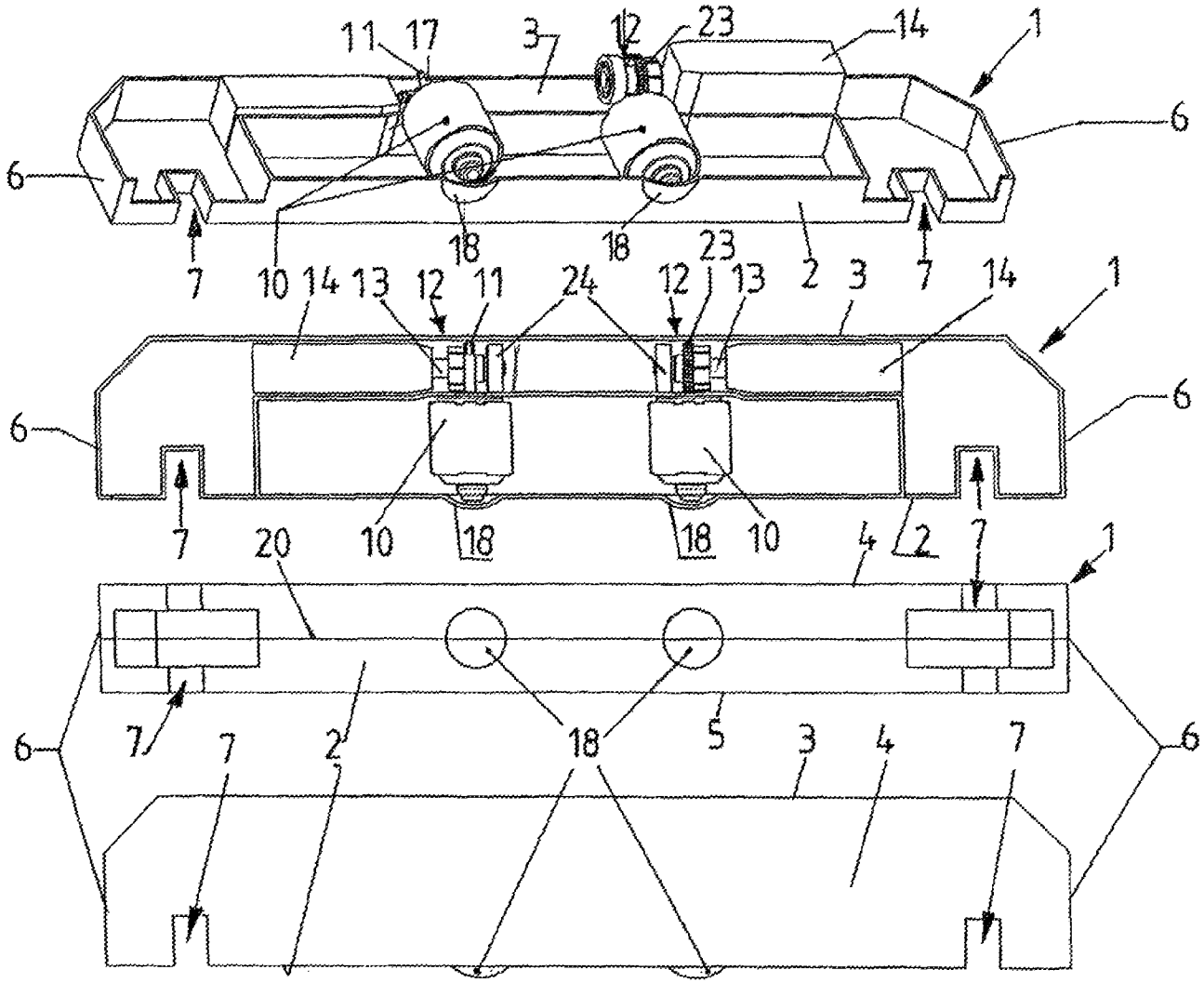
FIGS. 2 through 5 schematically illustrate a first embodiment, partially assembled in FIGS. 2 and 3 and in the final desired installation position in FIGS. 4 and 5.

As seen in FIG. 1 a housing 1 has elongated horizontal and generally planar upper and lower walls 2 and 3, elongated vertical and generally planar side walls 4 and 5, and short planar end walls 6. The upper wall 2 and side walls 4 and 5 have notches or seats 7 (FIGS. 2-4) that receive shafts indicated by dot-dash lines 8. These shafts 8 are rotatably attached to parts of the furniture and each have a control arm 15 (FIG. 6 only) for positioning the respective part. Two servomotors 10 are mounted on the housing 1 and each have an output shaft 11 defining an axis 16 and a transmission 12, such that a thrust spindle 13, a spindle nut, and a thrust piece 14 connected thereto can act on a respective control arm projecting from the shaft 8 toward the lower wall 3 of the housing 1 so as to rotate the respective shaft 8. The transverse internal height of the housing 1 between the lower face of its upper wall 2 and the upper face of its lower wall 3 is slightly greater than the diameter of the shaft 8 plus the length of the control arm affixed thereto.

The servomotors 10 are mounted in the housing 1 such that the axes 16 formed by their output shafts 11 are not aligned parallel to the parallel shafts 8. As is evident from FIG. 1 of the drawing, the axes 16 of the servomotors 10 run approximately at an angle of 65° to the respective shafts 8. Anything other than an alignment of the axes 16 parallel to the respective shafts 8 is possible for the output-shaft axes 16. Thus it is possible to achieve an especially slim design of the housing 1 depending on the alignment and angular position.

The pair of shafts 8 or the grooves formed by the seats in the side walls 4 and 5 of the housing 1 for these shafts 8 lie in a common first plane $P_1$ that runs parallel to the upper wall 2 and the lower wall 3, and indicated by the dot-dash line 8. The servomotors 10 are mounted in the housing 1 such that their output-shaft axes 16 formed by their output shafts 11 are oriented at an angle relative to this first plane $P_1$, as indicated in FIG. 1 of the drawing. The two axes 16 are parallel and lie in a second plane $P_2$ that intersects the first plane $P_1$ (indicated by the dot-dash line 8) at an acute angle a.

The angle a between the axis 16 and the respective shaft 8, or the angle a between the first plane $P_1$ (dot-dash line 8) and the second plane $P_2$ (dot-dash line 16) is greater than 0° and less than 180°. Preferably, the angle a is greater than 60° and less than 120°. An especially slim design is in fact achieved when the angle a is 90°; however, an especially slim design is achievable even with variations of ±10°. Notwithstanding the angular positions shown in the drawing, angular positions are also possible not only transverse to the housing but also in the longitudinal axis of the housing so as to minimize the overall size of the drive mechanism.

As is evident in drawing FIG. 1, the length of each servomotor 10 including its output shaft 11 together with a worm 17 affixed thereon amounts to the dimension of the housing 1 between the upper and lower walls 2 and 3 of the housing 1 as measured parallel to the motor axes 16; or this length is slightly greater, as is shown in the drawing where in that case the housing 1 has a cup-like projection 18 into which the end of servomotor 10 facing away from the worm 17 fits. It is also possible for the side wall 4 to have a corresponding protrusion in a region 21 to enable sections of the obliquely oriented servomotor 10 to be accommodated. A projection 22 that is not required but that can receive a transformer forming part of a power supply for servomotors 10 can also be provided.

The height of such cup-like projections 18 is preferably less than 10% of the height of the housing 1 between the lower face of the upper wall 2 and the upper face of the lower wall 3. The housing width between the side walls 4 and 5 of the housing is preferably at a maximum 20% greater than the overall diameter of a servomotor 10.

Figure 6:
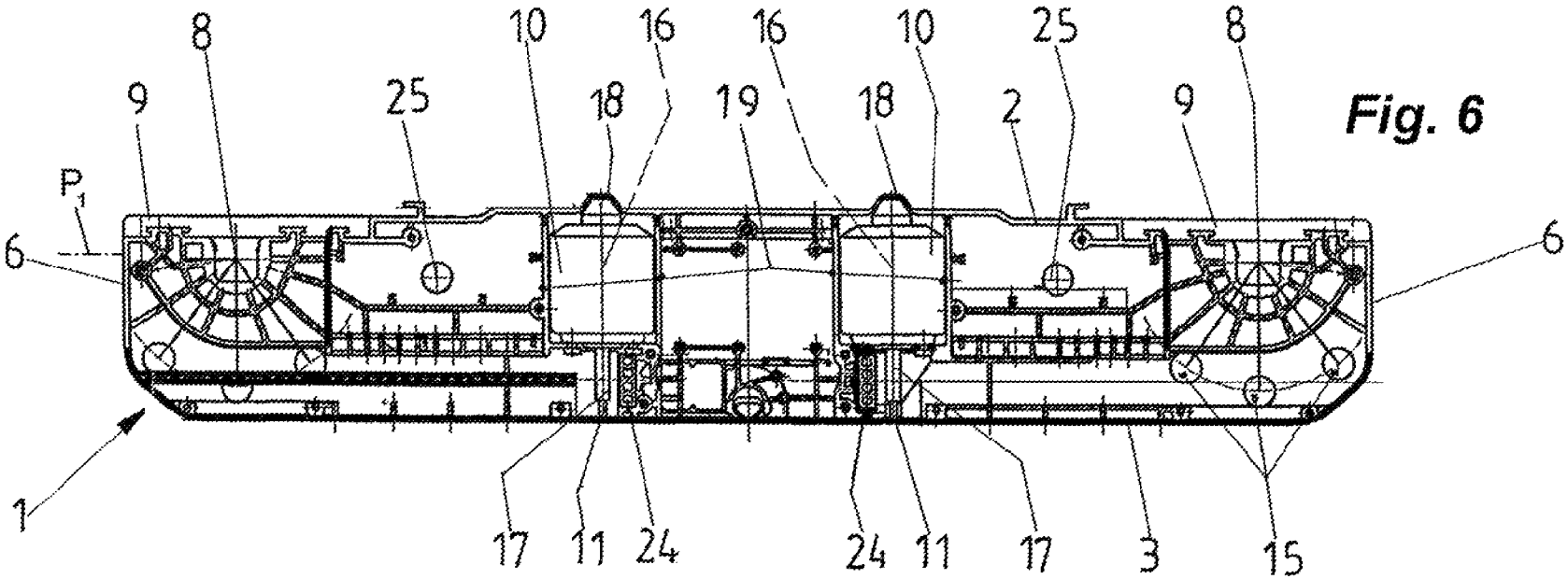
FIG. 6 show a second embodiment in a partially assembled position.
Figure 7:
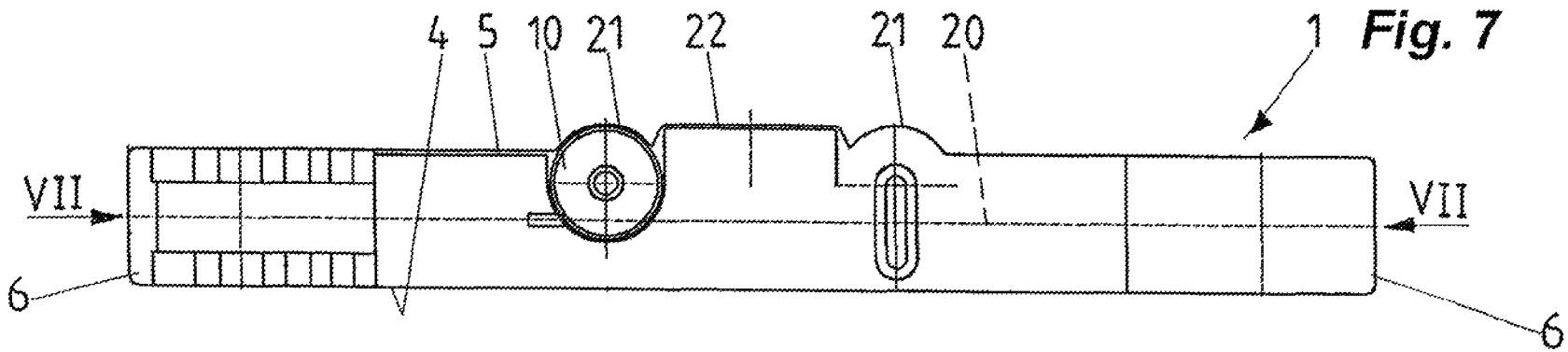
FIG. 7 shows the second embodiment in the desired installation position, partially opened.
Figure 9:
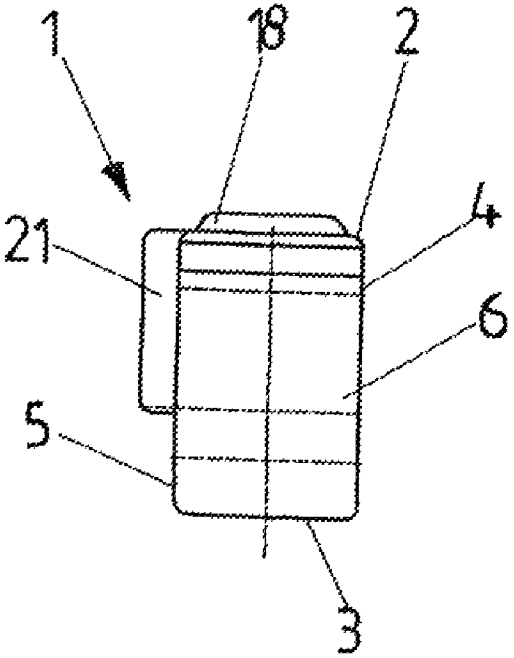
FIG. 9 shows the drive mechanism as viewed in the direction of arrow right-hand VII of FIG. 7.
Figure 8:
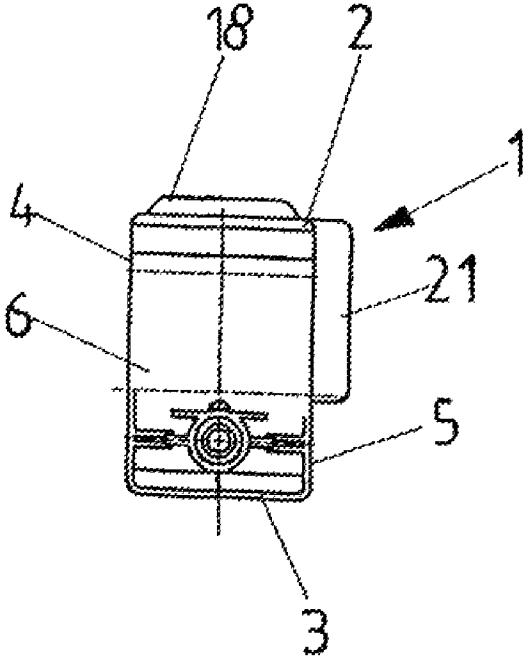
FIG. 8 shows the drive mechanism from the end as indicated by left-hand arrow VII of FIG. 7.
Figure 10:
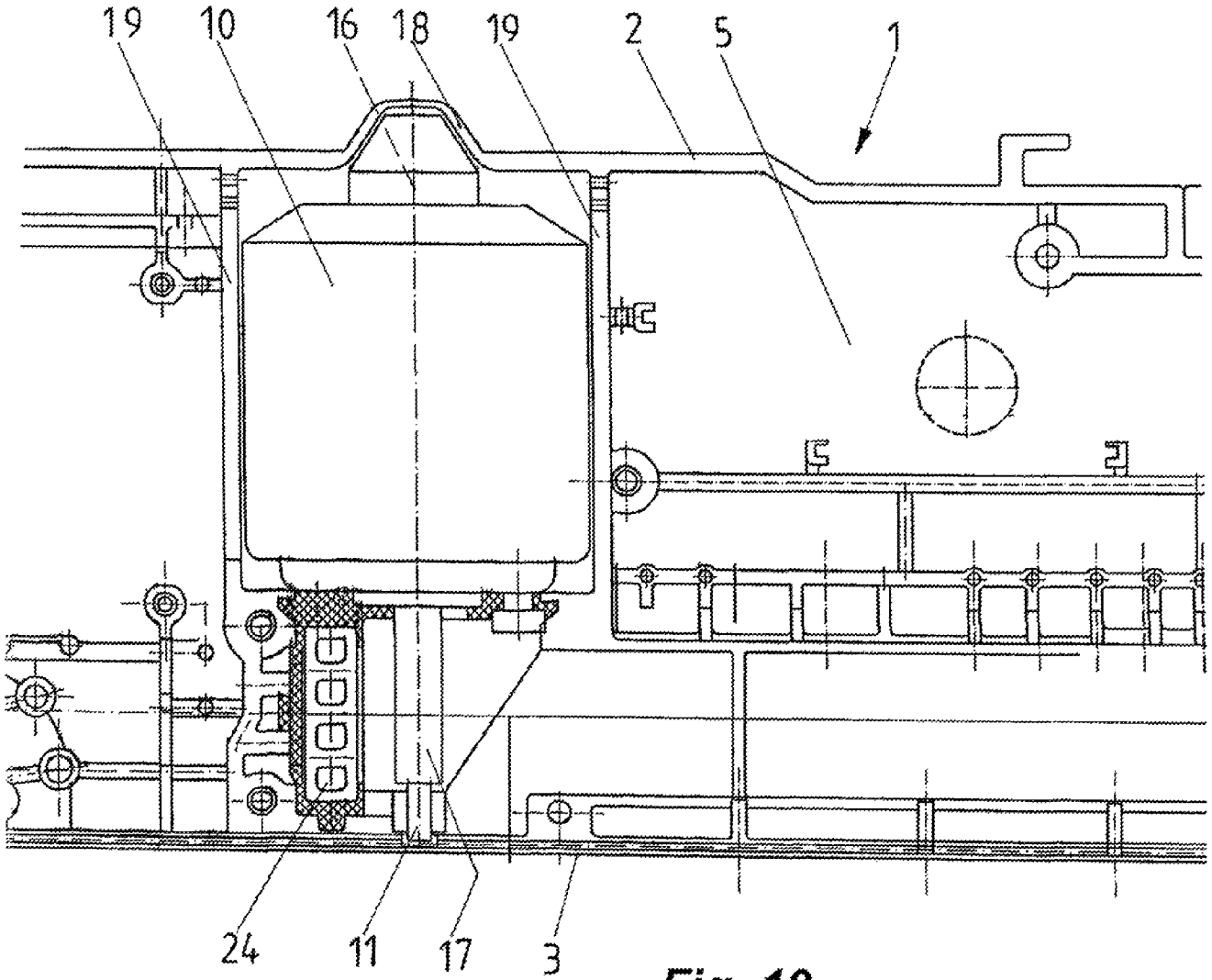
FIG. 10 is an enlarged view of a detail of FIG. 6.

More particularly the drive mechanism shown in FIGS. 6 and 7 has, for example, a height of 120 mm plus 8.5 mm overhang for the upper-side wall protrusions 18. The length of the drive mechanism is, for example, 700 mm, while the width as seen in a top view is a maximum of approximately 100 mm.

The drawing illustrates the essential parts of a drive mechanism for positioning parts of seating or reclining furniture, in particular, a slatted frame forming part of a couch or bed. The upper wall 2 in the desired installation position faces upward toward the adjustable furniture part, the lower wall 3 that faces downward away from the adjustable furniture part, and the side walls 4 and 5 extend vertically. The pairs of horizontally aligned notches 7 each receive a shaft 8 that is rotatably attached to the furniture and has an unillustrated control arm for positioning the respective parts of the furniture. Here only a center axis of each shaft is shown at 8. FIG. 6 shows how the housing 1 has locking parts 9 by which the shaft 8 is captured in the desired installation position on the housing 1. These locking parts are sliding elements that are pushed up transversely to the housing in the area of the upper wall 2 and are locked with appropriate slot connections.

The servomotors 10 mounted between the notches 7 each have the output shaft 11 that each in turn carry a gear-type transmission 12, a thrust spindle 13, a spindle nut, and a thrust piece 14 that act on a control arm 15 that projects radially away from the shaft 8 into the housing 1 and toward the lower wall 3 of the housing 1 and that is shown schematically in FIG. 6 in various positions. The height of the housing 1 between the upper wall 2 and the lower wall 3 is slightly greater than the diameter of the shaft 8 plus the length of the control arm 15.

The servomotors 10 are mounted in the housing 1 such that their output-shaft axes 16 formed by their output shaft 11 lie in the second plane $P_2$ that runs parallel to a center longitudinal plane of the housing 1 and is aligned parallel to the side walls 4 and 5 of the housing 1. Although other positions are possible, in this embodiment the output shafts 11 are aligned parallel to the side walls 4 and 5 of the housing 1, and orthogonally relative to the upper wall 2 and the lower wall 3 of the housing. In contrast to what is illustrated in the drawing, the length of each servomotor 10 including its output shaft 11 and worm 17 affixed thereon can also be dimensioned to be equal to the height of the housing between the upper wall 2 and the lower wall 3, or be less than this height. The width of the housing between the housings the side walls 4 and 5 is slightly greater than the overall diameter of a servomotor 10.

In the embodiment of FIGS. 2 through 5, the servomotors 10 are mounted centrally between the side walls 4 and 5, while the transmission elements (12 through 14) are displaced eccentrically from the housing toward one side wall 5. In the embodiment of FIGS. 6 through 10, the housing width between the side walls 4 and 5 is also slightly greater than the overall diameter of a servomotor 10, although the servomotors 10 at their center axis 16 are offset relative to center longitudinal plane 20 of the housing 1 toward one side wall 5. This side wall 5 consequently has first bulges 21 that match the degree of offset such that the first bulges 21 surround the peripheral surfaces of servomotors 10 by less than half. The overhang of the first bulges 21 beyond the side walls 5 is less than half the diameter of each servomotor 10, preferably less than quarter the diameter.

As is illustrated in the drawing, the housing 1 is composed of two housing shells, where the joint face runs at the longitudinal center of the housing 1 orthogonally relative to the upper wall 2 and the lower wall 3, as is indicated by the center longitudinal plane 20. This design enables the requisite functional elements to first be inserted into the one open shell during assembly. The second shell can then be mounted and attached to the first shell, thereby making the drive mechanism ready for use.

The transmission 12 is composed of the worm 17 that is fixed on the respective output shaft 11, and a worm gear 23 that is fixed to the thrust spindle 13, the worm gear 23 being effectively engaged with the worm 17. In the embodiment of FIGS. 2 through 5, the servomotor 10 with its worm 17 is mounted centrally between the side walls 4 and 5 of the housing 1, while the worm gear 23 is offset eccentrically next to the worm 17, as are the following elements for actuating control arm 15. In the embodiment of FIGS. 6 through 10, the worm gear 17 is mounted centrally between the side walls 4 and 5 of the housing 1, while the servomotor 10 with its worm 17 is offset eccentrically next to the worm gear, as is especially evident in the top view of FIG. 7.

The thrust spindle 14, shown here only schematically, with its end region projecting beyond worm gear 23 is rotatably mounted in a bearing 24 that is fixed in the housing. The side wall 5 has at least one plug-in connector 25 to allow connection of electrical wires that are routed from outside to the drive mechanism and connected to this mechanism.

As is evident in the drawing, the servomotors close to the longitudinal center of the housing 1 are attached with a clearance relative to each other such that a transformer electrically connected to the servomotors 10 can be attached to the housing 1. As is also evident in the drawing, the overall size of the drive mechanism is dimensioned to be extremely small while taking into account the technical requirements, thereby enabling a large number of drive mechanisms to be packed in a small volume for shipment. As a result, shipping costs can be significantly reduced as compared to the known embodiments without degrading the technical functionality of the drive mechanism.

The invention is not restricted to the illustrated embodiment but can be varied in multiple ways within the scope of the invention.

All individual features and combined features disclosed in the description and/or drawing are considered to be essential to the invention.

I claim:

1. A drive mechanism for a piece of reclining furniture, the mechanism comprising:

a housing having longitudinally extending upper and lower walls, a pair of side walls extending vertically between the upper and lower walls, and a pair of longitudinally spaced end walls, the side walls being formed adjacent the upper wall with a pair of longitudinally spaced seats defining a pair of generally parallel and transversely extending axes lying in a common first plane;

respective furniture shafts rotatable in the seats and connectable to parts of the piece of reclining furniture;

respective control arms projecting radially of the axes into the housing from rotation axes of the furniture shafts;

respective servomotors in the housing between the upper, lower, and side walls thereof, each servomotor having an output shaft defining a respective output rotation axis, the output rotation axes defining a second plane forming an angle greater than 0° with the first plane;

respective transmissions and links between the output shafts and the control arms, whereby rotation of the output shafts is transmitted through the respective transmissions and links to the control arms to rotate the furniture shafts.

2. The drive mechanism defined in claim 1 wherein the angle is greater than 45° and less than 135°.

3. The drive mechanism defined in claim 1 wherein the angle is greater than 60° and less than 120°.

4. The drive mechanism defined in claim 1 wherein the angle is 90°±10°.

5. The drive mechanism defined in claim 1 wherein a length of each servomotor and the respective output shaft measured parallel to the respective output axis is approximately equal to a vertical spacing between the upper wall and the lower wall.

6. The drive mechanism defined in claim 1 wherein one of the top and bottom walls is formed with a pair of cup-like projections into which the motors fit, the projections having a height equal to at most 10% of a height of the housing.

7. The drive mechanism defined in claim 1 wherein the housing has an internal transverse width measured between the side walls equal to at most 20% more than a diameter of the servomotors.

8. The drive mechanism defined in claim 1 wherein the output axes extend parallel to the side walls.

9. The drive mechanism defined in claim 8 wherein the output axes are perpendicular to the top and bottom walls.

10. The drive mechanism defined in claim 1 wherein one of the side walls is formed with an outward bulge, the mechanism further comprising a transformer inside the housing, connected to the servomotors, and fitted to the bulge.

11. The drive mechanism defined in claim 1 wherein one of the side walls is formed with a pair of bulges into each of which a respective one of the servomotors is fitted, the bulges projecting transversely from the housing by a distance equal to less than half of a diameter of the respective servomotor.

12. The drive mechanism defined in claim 1 wherein each of the transmissions includes a worm gear fixed on the respective output shaft.

13. The drive mechanism defined in claim 12 wherein each transmission includes a thrust bearing connected between the respective worm gear and the respective control arm.

14. The drive mechanism defined in claim 13 wherein the thrust bearing has a gear engaging the respective worm gear.

15. The drive mechanism defined in claim 14 wherein the thrust bearing is rotatable in the housing about a longitudinal axis.

16. The drive mechanism defined in claim 1 wherein the housing is formed by two parts each defining a respective one of the side walls and a respective half of the upper, lower, and end walls, the two parts being fitted together at a joint plane perpendicular to the upper and lower walls.

17. The drive mechanism defined in claim 1, further comprising a plug connector connected to the servomotors and mounted on one of the walls.

18. The drive mechanism defined in claim 17 wherein the plug connector is mounted on one of the side walls.

19. The drive mechanism defined in claim 1, further comprising a transformer in the housing between and connected to the servomotors.

20. The drive mechanism defined in claim 1 wherein the housing is formed with notches forming the seats.

* * * * *